US011466897B2

(12) United States Patent
Fratianne

(10) Patent No.: US 11,466,897 B2
(45) Date of Patent: Oct. 11, 2022

(54) CONVERTIBLE END CAP AND BASEBOARD HEATER COVER ASSEMBLY

(71) Applicant: Gary Fratianne, Avon Lake, OH (US)

(72) Inventor: Gary Fratianne, Avon Lake, OH (US)

( * ) Notice: Subject to any disclaimer, the term of this patent is extended or adjusted under 35 U.S.C. 154(b) by 915 days.

(21) Appl. No.: 16/198,111

(22) Filed: Nov. 21, 2018

(65) Prior Publication Data

US 2019/0154302 A1 May 23, 2019

Related U.S. Application Data

(60) Provisional application No. 62/589,758, filed on Nov. 22, 2017.

(51) Int. Cl.

| | |
|---|---|
| ***F24H 9/02*** | (2006.01) |
| ***F24D 19/06*** | (2006.01) |
| ***F24D 3/14*** | (2006.01) |
| ***F24H 3/00*** | (2022.01) |
| ***E04F 19/04*** | (2006.01) |

(52) U.S. Cl.

CPC ..... *F24H 9/02* (2013.01); *E04F 19/04* (2013.01); *F24D 3/145* (2013.01); *F24D 19/06* (2013.01); *F24H 3/002* (2013.01); *E04F 2019/044* (2013.01); *E04F 2019/0413* (2013.01); *F24D 2220/2072* (2013.01)

(58) Field of Classification Search

None

See application file for complete search history.

(56) References Cited

U.S. PATENT DOCUMENTS 1,455,399 A * 5/1923 Keavaney ..... H01R 13/447 220/242
1,855,565 A * 4/1932 Bennett ..... F24D 19/04 237/79
2,489,847 A * 11/1949 Arnold ..... F28D 1/053 237/79
2,662,747 A * 12/1953 Trane ..... F24D 19/04 165/96
2,799,213 A * 7/1957 Hansen ..... F24F 7/04 454/287
2,799,763 A * 7/1957 Hicks ..... 392/353
2,872,162 A * 2/1959 Marini ..... F24D 19/04 165/96
2,954,456 A * 9/1960 Calhoun ..... F24H 3/002 392/353
2,970,678 A * 2/1961 Brinen ..... F24D 19/04 285/284.1
2,972,044 A * 2/1961 Smith ..... F21V 17/00 174/72 R
2,993,978 A * 7/1961 Markel ..... F24H 3/002 165/182
3,020,382 A * 2/1962 Harrell, Jr. ..... F24H 3/002 392/353
3,051,816 A * 8/1962 Knoll ..... F24H 3/002 165/181

(Continued)

*Primary Examiner* — Thor S Campbell

(74) *Attorney, Agent, or Firm* — Fay Sharpe LLP

(57) ABSTRACT

The present disclosure relates to a heater cover assembly for baseboard heater units and components thereof. The components include convertible end caps having cutouts and cover plates that can be used with baseboard heating units. The cutouts accommodate pipes or other obstructions that would otherwise prevent or hinder installation of the end cap.

20 Claims, 4 Drawing Sheets

(56) References Cited

U.S. PATENT DOCUMENTS 3,074,521 A * 1/1963 Woods ..... F24D 19/04 52/261
3,141,499 A * 7/1964 Bunten ..... F24D 19/04 165/55
3,165,624 A * 1/1965 Cunningham ..... F24H 3/002 165/184
3,221,139 A * 11/1965 Orr ..... F24H 3/002 219/536
3,257,258 A * 6/1966 D Andrea ..... B21D 51/383 156/521
3,294,158 A * 12/1966 Baljet ..... F24D 19/04 392/353
3,310,652 A * 3/1967 Williams, Jr. ..... F24H 3/002 165/182
3,398,786 A * 8/1968 McNabney ..... F24D 19/04 165/69
3,408,479 A * 10/1968 Welch, Sr. ..... F24H 3/004 165/104.19
3,448,243 A * 6/1969 Ripple ..... F24H 3/002 237/79
3,470,351 A * 9/1969 Fischer ..... H05B 3/32 219/541
3,543,003 A * 11/1970 Dincher ..... F24H 3/002 165/182
3,551,642 A * 12/1970 Knoll ..... F24H 3/002 165/182
3,566,077 A * 2/1971 Steiner ..... F24H 3/002 392/353
3,582,614 A * 6/1971 Zellers ..... F24C 7/043 165/53
3,679,868 A * 7/1972 England ..... F24H 3/002 337/324
4,018,982 A * 4/1977 Svekis ..... F24H 3/002 174/663
4,097,720 A * 6/1978 Sand ..... F24H 3/002 165/53
4,149,065 A * 4/1979 Goff ..... F24H 3/002 219/541
4,157,731 A * 6/1979 Denhart ..... F24D 19/04 392/352
4,311,898 A * 1/1982 McMillan ..... F24H 7/0416 126/400
4,430,521 A * 2/1984 Ofield ..... F24H 9/1863 174/663
4,761,537 A * 8/1988 Hayes ..... F24C 7/043 165/182
4,877,361 A * 10/1989 DeRosa ..... B60P 7/0807 410/112
D309,776 S * 8/1990 Rudolph ..... D23/385
5,047,786 A * 9/1991 Levy ..... F24H 3/002 165/53
5,064,969 A * 11/1991 Bloom ..... H02G 3/185 174/67
5,191,171 A * 3/1993 Bordwell ..... H02G 3/085 220/268
D338,526 S * 8/1993 Reed ..... D23/389
D338,716 S * 8/1993 Reed ..... D23/389
5,276,279 A * 1/1994 Brownlie ..... H02G 3/10 174/650
5,402,830 A * 4/1995 Dortzbach ..... F16L 7/00 D23/266
5,652,826 A * 7/1997 Mills ..... F24H 3/0417 392/360
5,728,973 A * 3/1998 Jorgensen ..... H02G 3/085 174/666
5,743,327 A * 4/1998 Villa ..... F28D 1/0246 165/76
6,003,596 A * 12/1999 Barba ..... F24D 19/0087 165/53
6,085,985 A * 7/2000 LaSelva ..... F24D 19/06 237/79
D643,913 S * 8/2011 Ching ..... D23/342
8,347,950 B2 * 1/2013 Stroobants ..... F24D 19/0087 362/147
10,871,292 B2 * 12/2020 Kehoe ..... F24D 3/1066
11,085,832 B2 * 8/2021 Spors ..... F24F 13/20
2002/0175217 A1 * 11/2002 Uglietto ..... F24D 19/06 237/79
2005/0078952 A1 * 4/2005 Bain ..... F24H 3/0411 392/360
2006/0182429 A1 * 8/2006 Shapiro ..... F24H 3/0411 392/365
2007/0175124 A1 * 8/2007 Webster ..... F24D 19/04 52/220.1
2009/0085713 A1 * 4/2009 Tsang ..... H05B 1/0277 392/374
2010/0032182 A1 * 2/2010 Arbel ..... H02G 3/14 174/66
2016/0273785 A1 * 9/2016 Marino ..... F24D 19/06
2018/0058713 A1 * 3/2018 Spors ..... H05K 5/0213

* cited by examiner

CONVERTIBLE END CAP AND BASEBOARD HEATER COVER ASSEMBLY

CROSS-REFERENCE TO RELATED APPLICATIONS

This application claims priority to U.S. Provisional Patent Application Ser. No. 62/589,758, filed Nov. 22, 2017, the entirety of which is incorporated by reference herein.

BACKGROUND

The present disclosure is directed to covers for baseboard heating units. More particularly, it is directed to heater cover assemblies for baseboard heater units and components thereof. More specifically, convertible end caps having a cutout and optional cover are disclosed.

Baseboard heaters are typically long low profile units that run along the base of a wall and are used to provide heat in living spaces. A typical baseboard heater is a housing associated with a heating element contained in the housing, such as a resistive heating element or a fluid heating element.

The housings of many existing baseboard heating units are old and are undesirably styled, rusted, dented, or generally unattractive. Many existing baseboards include piping or other obstacles that make installing a new baseboard cover system difficult. It would be desirable to provide a baseboard heater cover that could provide a pleasing aesthetic appearance, and have the ability to account for piping or other obstacles, so as to improve ease of installation.

SUMMARY OF THE DISCLOSURE

The present disclosure relates to end caps with cover plates that can be used in a heater cover assembly. Generally, the end caps and cover plates contain additional apertures that permit them to be placed for use on a baseboard heating unit.

Disclosed in various embodiments are end caps for a heater cover assembly. The end caps include a closed face comprising an interior surface and exterior surface. The closed face includes a cutout. The closed face also includes a retaining clip which is located on the interior surface. The clip is adapted to receive and retain an associated cover plate that covers the cutout. An open face opposite the closed face accommodates the insertion of an associated heater cover panel. The open face gives access to the interior volume of the end cap. A top face is present. A front face comprises an interior surface and an exterior surface. A retainer is fixed to the interior surface of the front face and is adapted to hold an associated heater cover panel in place. A rear face is also present. A top aperture is positioned along a top edge of the rear face. At least one bottom aperture is positioned along a bottom edge of the rear face, which is adapted to accommodate a fastener for attaching the end cap to a wall.

In some embodiments, the cover plate includes a flat portion and a plateau portion, the flat portion adapted to abut the interior surface of the closed face, the plateau portion adapted to fill the cutout portion of the closed face such that when the cover portion is in place the exterior surface of the closed face appears as a solid flat surface.

Also disclosed herein are heater cover assemblies for covering a baseboard heater, comprising: a first end cap and a second end cap; and a first heater cover panel having a first panel end and a second panel end; wherein the first panel end is inserted into the open face of the first end cap and held in place by the fixed retainer on the interior surface of the front face. At least one of the end caps has the structure described above.

The second panel end can be inserted into the open face of the second end cap and held in place by the fixed retainer on the interior surface of the front face of the second end cap.

The assembly sometimes further comprises a coupler and a second heater cover panel. The coupler is used to disguise the location where the two heater cover panels meet.

The first heater cover panel, the first end cap, and the second end cap can be made of galvanized steel. The first heater cover panel may contain vents.

These and other non-limiting aspects of the disclosure are discussed further below.

BRIEF DESCRIPTION OF THE DRAWINGS

The following is a brief description of the drawings, which are presented for the purposes of illustrating embodiments disclosed herein and not for the purposes of limiting the same.

DETAILED DESCRIPTION

Figure 1:
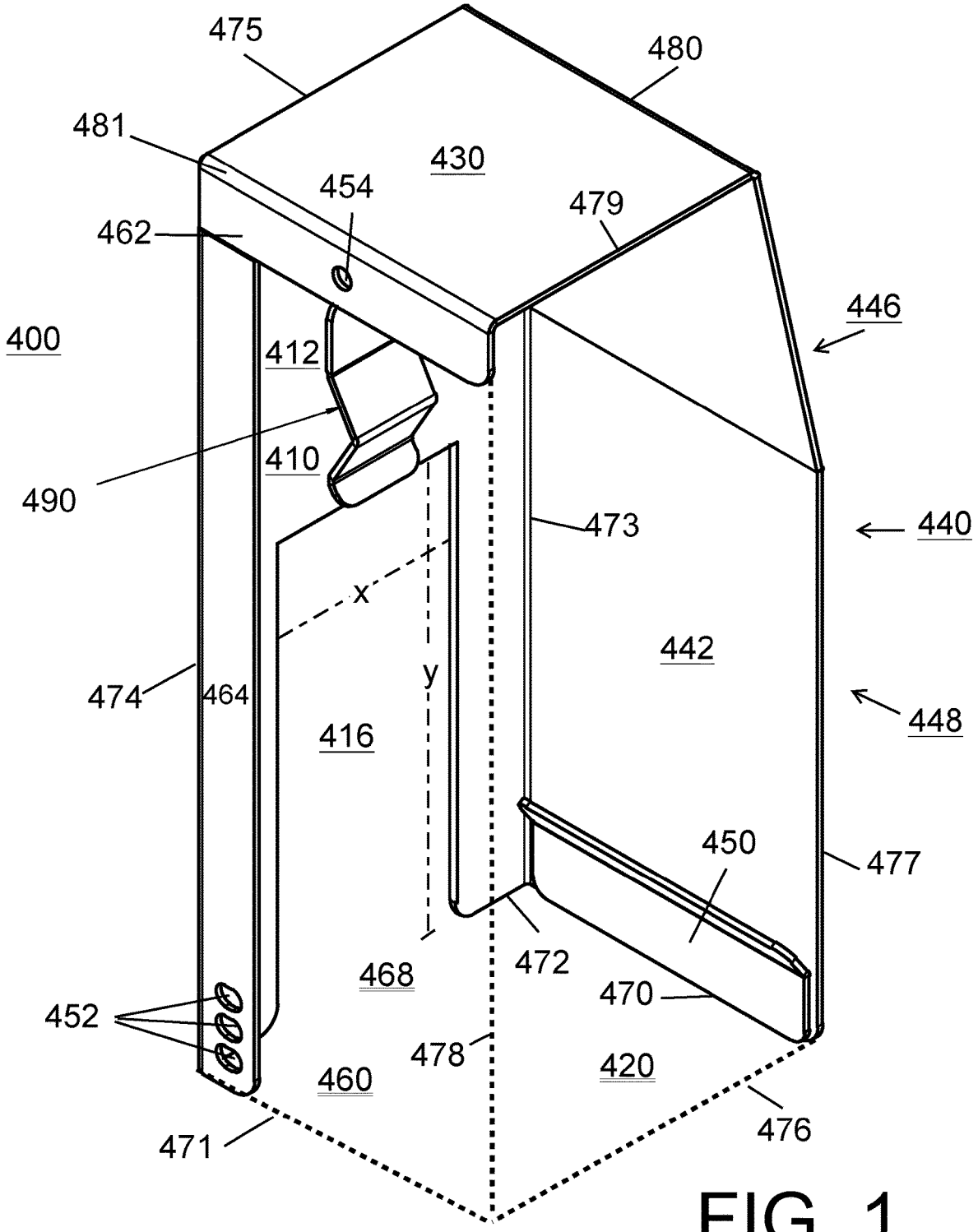
FIG. 1 is a rear perspective view of an end cap having a cutout.

A more complete understanding of the devices and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the terms "comprise(s)," "include(s)," "having," "has," "can," "contain(s)," and variants thereof, as used herein, are intended to be open-ended transitional phrases that require the presence of the named components/parts and permit the presence of other components/parts. However, such description should be construed as also describing devices "consisting of" and "consisting essentially of" the enumerated components/parts, which allows the presence of only the named components/parts and excludes other components/parts.

All ranges disclosed herein are inclusive of the recited endpoint and independently combinable (for example, the range of "from 2 watts to 10 watts" is inclusive of the endpoints, 2 watts and 10 watts, and all the intermediate values). Numerical values should be understood to include numerical values which are the same when reduced to the same number of significant figures and numerical values which differ from the stated value by less than the experimental error of conventional measurement technique of the type described in the present application to determine the value.

As used herein, approximating language may be applied to modify any quantitative representation that may vary without resulting in a change in the basic function to which it is related. Accordingly, a value modified by a term or terms, such as "about" and "substantially," may not be limited to the precise value specified. The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number. For example, "about 10%" may indicate a range of 9% to 11%, and "about 1" may mean from 0.9-1.1.

Some of the terms used herein are relative terms. For example, the terms "front" and "rear" and "side" are relative to a center, with the front being spaced apart from and in the opposite direction of the rear, and opposite sides being spaced apart from each other along an axis normal to the axis from front to rear. "Top" and "bottom" are also relative terms. As used herein, the front and rear are located along an x-axis, the left and right are located along a y-axis, and the top and bottom are located along a z-axis, wherein the three axes are perpendicular to each other.

The terms "horizontal" and "vertical" are used to indicate direction relative to an absolute reference, i.e. ground level. However, these terms should not be construed to require structures to be absolutely parallel or absolutely perpendicular to each other. For example, a first vertical structure and a second vertical structure are not necessarily parallel to each other. The terms "upward" and "downward" are also relative to an absolute reference, i.e. the surface of the earth. Put another way, an element that extends "upward" always extends away from the surface of the earth, opposite an element that extends "downward" toward the surface of the earth.

The term "parallel" should be construed in its lay term as two edges or faces generally continuously having the same distance between them, and should not be strictly construed in mathematical terms as requiring that the two edges or faces cannot intersect when extended for an infinite distance. Similarly, the term "perpendicular" should not be construed as requiring that two faces meet at an angle of absolutely 90°.

The present disclosure relates to convertible end caps with cover plates for a baseboard heater cover assembly. The end caps include a cutout that allow them to be installed over piping or other obstacles included in the original baseboard heating assembly, when the cover plate is removed. The devices described herein can be used in combination with any baseboard heater, e.g. baseboard heaters having a resistive heating element or a fluid heating element. It is further contemplated that the present devices can be used wherever it is desirable to cover baseboard heaters, air vents, or the like. The present devices address the shortcomings of prior devices with respect to ease of use and versatility.

Figure 2:
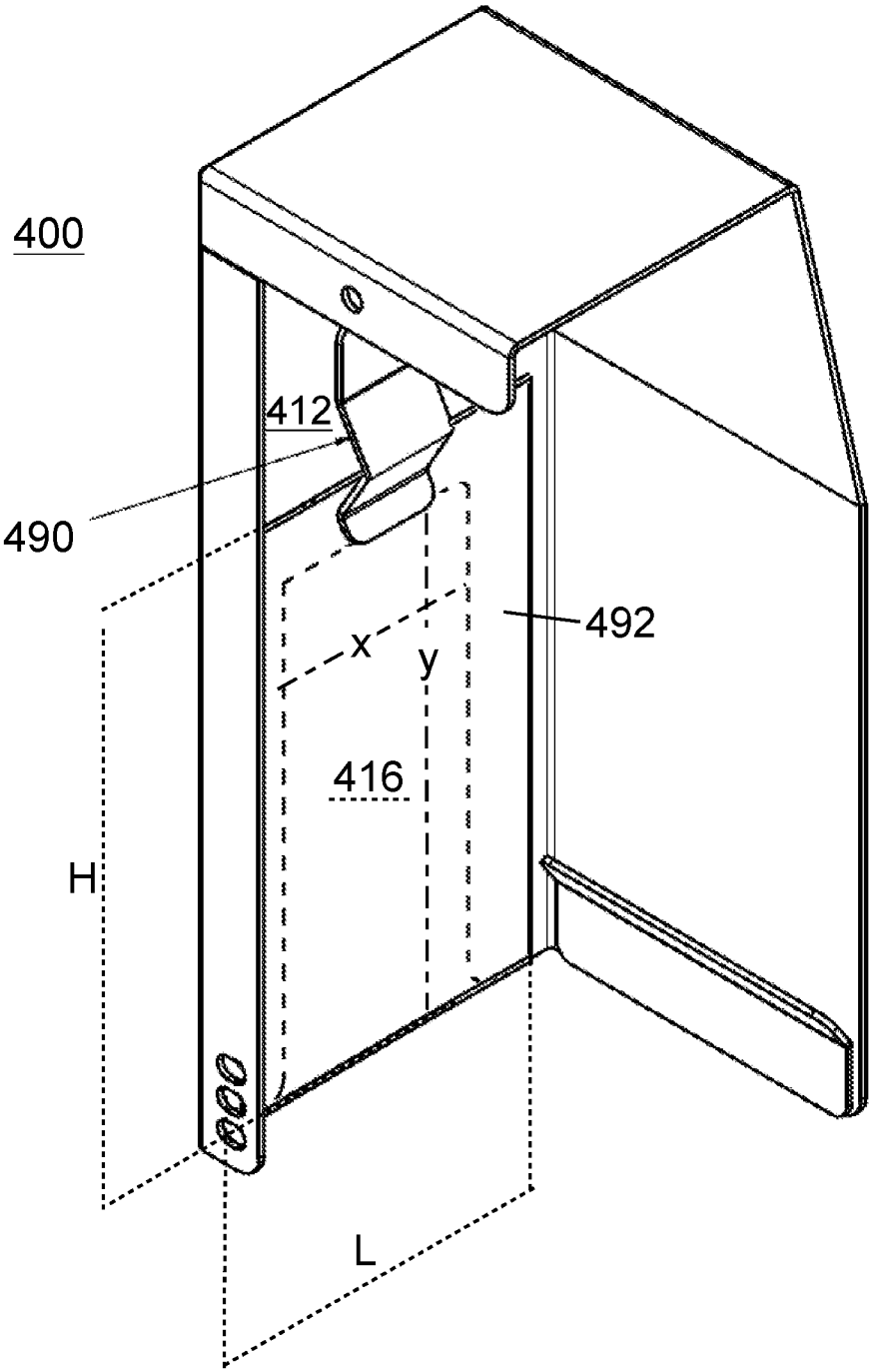
FIG. 2 is a rear perspective view of an end cap having a cutout covered with a cover plate.

FIG. 1 and FIG. 2 illustrate an exemplary embodiment of an end cap 400 for a heater cover assembly including a cutout portion. The end cap is formed from a closed face 410, an open face 420, a top face 430, a front face 440, and a rear face 460. The bottom of the end cap is open.

The closed face 410 has an interior surface 412 and an exterior surface (not visible), and can be considered a first side of the end cap. The perimeter of the abutment face is formed from a first top side edge 475, a first rear side edge 474, a first front side edge 473, and a first bottom side edge 472.

The open face 420 is on the other side of the end cap opposite the closed face 410, and can be considered a second side of the end cap. The open face gives access to the interior volume of the end cap and accommodates the insertion of a heater cover panel, as will be described further herein. The perimeter of the open face is formed from a second top side edge 479, a second rear side edge 478, a second front side edge 477, and a second bottom side edge 476.

The top face 430 is generally solid, i.e. has no holes or vents. The perimeter of the top face is formed from a top front edge 480, a top rear edge 481, a first top side edge 475, and a second top side edge 479.

It is noted that no bottom face is present. The sides of the end cap should be sized so that the top face 430 is generally parallel to the bottom face, which could be defined by bottom front edge 470, bottom rear edge 471, first bottom side edge 472, and second bottom side edge 476.

As illustrated here, the front face 440 is made of an upper surface 446 and a lower surface 448, with the lower surface being vertical and the upper surface being angled relative to the lower surface. The design of the front face 440 can contain one surface or multiple surfaces, based upon design preferences. The perimeter of the front face is formed from the top front edge 480, a bottom front edge 470, a first front side edge 473, and a second front side edge 477. It is noted that here, the front face is rectangular, with first front side edge 473 and second front side edge 477 being substantially parallel to each other.

The front face has an interior surface 442 and an exterior surface, with a generally constant thickness therebetween. A retainer 450 is fixed along the bottom edge 470 on the interior surface 442 of the front face 440. The retainer 450 is adapted to hold a heater cover panel in place, as will be illustrated in FIG. 4.

The rear face 460 is defined by the top rear edge 481, a bottom rear edge 471, the first rear side edge 474, and the second rear side edge 478. As illustrated here, the rear face is formed from two strips 462, 464 and has an opening 468. The first strip 462 is located along the top rear edge 481, and the second strip 464 is located along one of the rear side edges (here it is first rear side edge 474). However, it is also contemplated that the rear face could be solid with no openings.

In some embodiments, the rear face 460 contains at least one bottom aperture 452 positioned along the bottom edge 471 of the rear face 460, which is adapted to accommodate a fastener (e.g. screw, nail, staple, etc.) for fixing the end cap 400 to a wall. As illustrated here, the bottom apertures 452 are adjacent the closed face 410, and are present on second strip 464. In some exemplary embodiments, a top aperture 454 is located along the top edge 481 of the rear face 460. As illustrated here, the top aperture 454 is adjacent the open face 420. The top aperture is adapted to accommodate a fastener for additional attachment to a wall, or provide a means for additionally securing an inserted cover panel to the end cap with an associated fastener. The remainder of the rear face is open.

The end cap 400 includes a cutout 416 on the closed/abutment face 410. The cutout 416 has a length x and a height y. The cutout allows for the end cap 400 to be placed over a radiator section that may have a pipe or protrusion that would otherwise block the end cap from fitting over the radiator in an appealing manner. In particular embodiments, the length x can be from at least 0.5 inches, including from about 0.5 inches to about 2.5 inches. In particular embodiments, the height y can be at least 0.5 inches, including from about 0.5 inches to about 6.5 inches, and from about 0.5 inches to about 4.5 inches. In particular embodiments, the cutout is rectangular, with a height/length ratio of about 1.0 to about 2.0.

A removable and adjustable cover plate that completely or partially covers the open cutout 416 is included. To accomplish this, in some embodiments, a retaining clip 490 is fixed to the interior surface 412 above the cutout 416. The retaining clip 490 may be welded, adhered with an adhesive, or mechanically fixed with fasteners to the interior surface. The retaining clip can be a spring clip. Alternatively, the cover plate can be fixed in place using a mechanical fastener, for example by one or more screws that pass through the cover plate to fix it in place. As yet another alternative, the cover plate can be glued in place.

Referring now to FIG. 2, the clip 490 accommodates the insertion of a cover piece 492 and holds the cover piece in place over the cutout 416. The cover piece has a length L and a height H. In some embodiments, the cover piece has dimensions that are greater than the dimensions of the cutout 416. Specifically, L is greater than x and H is greater than y. This creates a cover piece 492 that, when inserted and retained by clip 490, completely covers the area of the cutout 416. By way of comparison, the height of the entire end cap is, in particular embodiments, about 7.5 inches or about 9 inches. The length of the entire end cap is, in particular embodiments, about 3 inches to about 4 inches.

In some embodiments, the height H may be less than or equal to the height y of the cutout. In these embodiments, when the cover piece is inserted and held by the clip 490 a bottom portion of the cutout is uncovered and exposed. This allows for the end cap to fit over a low radiator pipe or obstruction while aesthetically covering the top portion of the cutout.

The retaining clip 490 is designed such that it applies a force on cover plate 492 to press it against the interior surface 412. In some embodiments, the force applied is normal to the surface 412.

In some embodiments, a fastener on the retaining clip 490 allows the clip to be rotated, such that it can be hidden. When use of the cover plate is desired, the cover plate 492 may be placed in a desired location and the retaining clip rotated such that it overlaps and presses the cover plate against the interior surface 412.

Figure 3A:
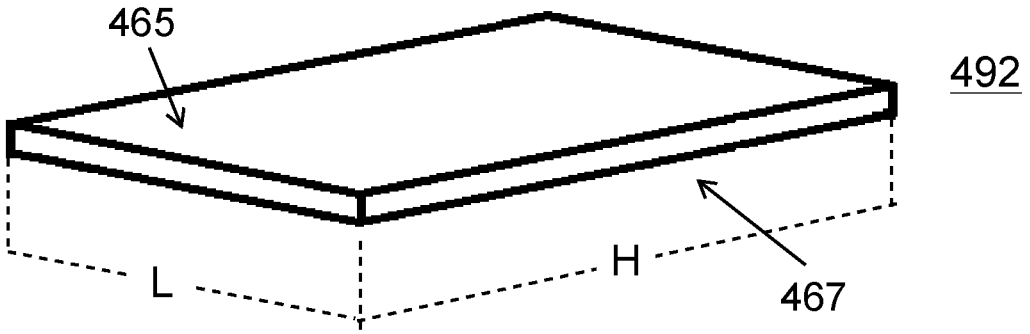
FIG. 3A and FIG. 3B are perspective views of two different cover plates in accordance with the present disclosure. The plate of FIG. 3A is flat, while the plate of FIG. 3B includes a plateau portion for filling in the cutout.

In some exemplary embodiments, as illustrated in FIG. 3A, the cover plate 492 is a substantially flat piece of material having a flat top surface 465 and flat bottom surface 467, height H and length L. The flat top surface 465 and flat bottom surface 467 of the cover plate 492 are substantially parallel to each other.

Figure 3B:
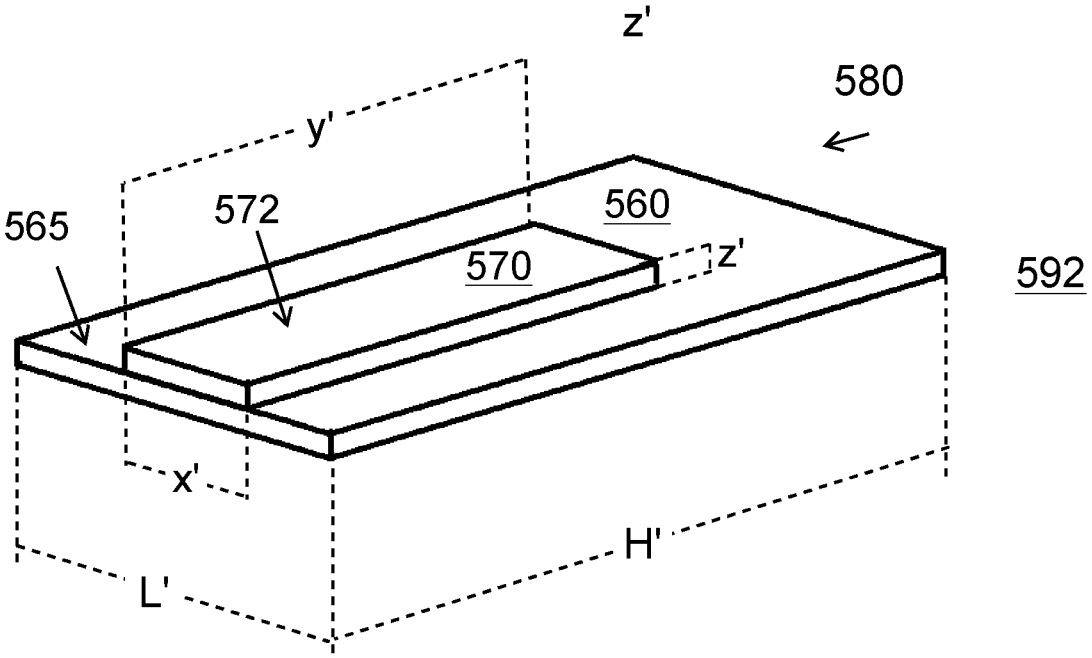

In other exemplary embodiments, as shown in FIG. 3B, the cover plate 592 includes a flat portion 560, plateau portion 570, and top end 580. The flat portion 560 includes a top surface 565 and the plateau portion has a top surface 572. The flat portion 560 has dimensions H' and L' and the plateau portion has dimensions y', x', and z'. The dimensions of the plateau portion are the same or substantially similar to the dimensions of an end cap cutout 416 (see FIG. 1). The dimension z' is the same or substantially similar to the thickness of the closed side 410. When the cover plate 592 is positioned in place, the retaining clip 490 engages the top end 580 of the cover plate and the plateau portion 570 fills the open space of the cutout 416. The top surface 565 of the flat portion 560 contacts the inner surface 412 of the closed end 410. When z' is a similar dimension to the thickness of the closed end 410 wall the cover plate 592 creates a flush appearance on the exterior surface of the closed end 410. By comparison, the cover plate 492 of FIG. 3A does not have a plateau portion.

Figure 4:
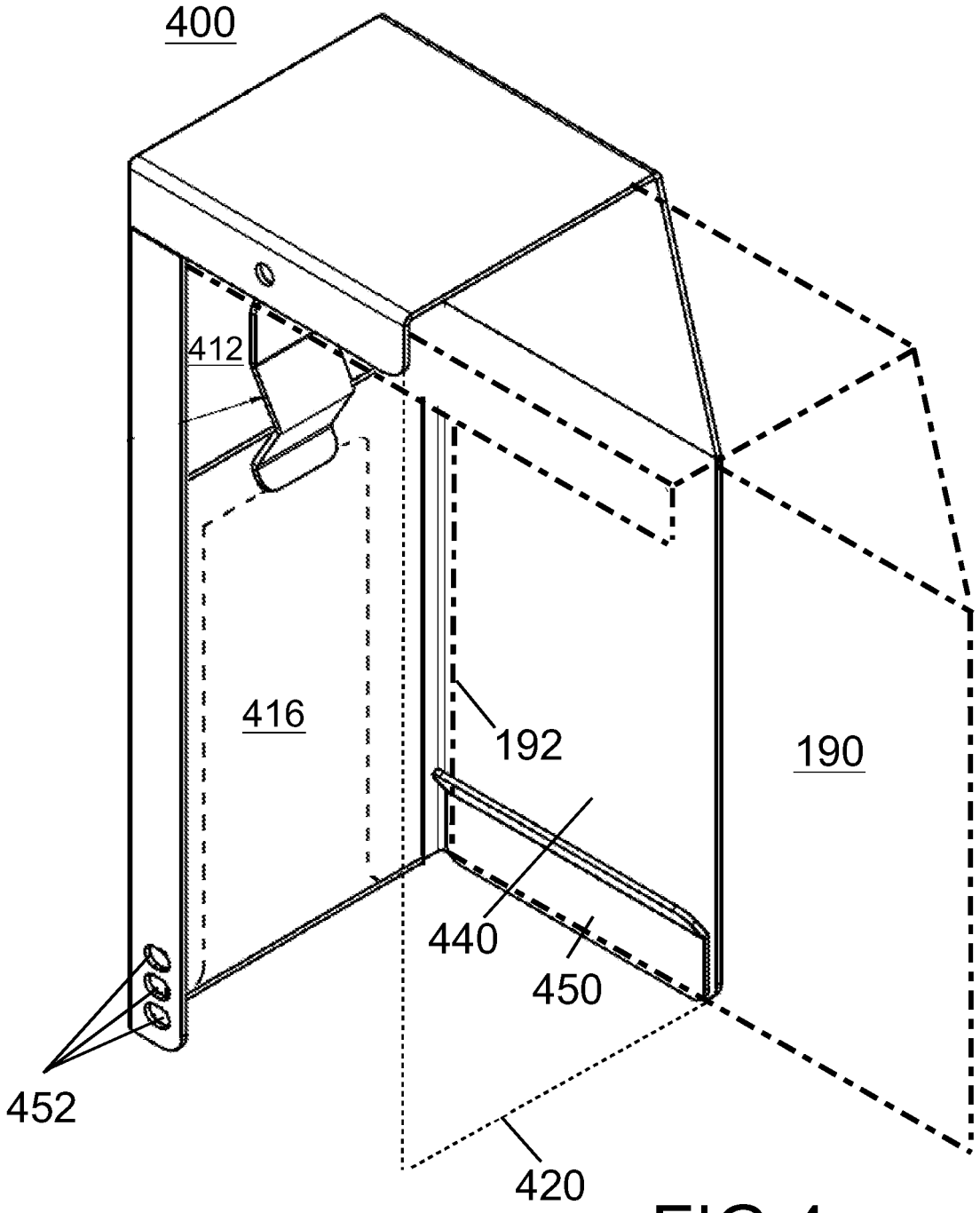
FIG. 4 is a rear perspective view of a heater cover panel inserted into the open face of an end cap. The heater cover panel is illustrated with dashed lines, and the end cap is illustrated with solid lines.

FIG. 4 shows an end cap 400 with a heater cover panel 190 inserted through the open face 420 and into the interior volume of the end cap 400. As illustrated, the cover panel 190 is supported by the retainer 450 and fixed against the front face 440. The first end 192 of the cover panel abuts and is adjacent to the interior surface 412 of the closed face 410.

The end cap 400 is designed such that it can accommodate the heater cover panel 190 as well as fit over the end of a baseboard heater unit. When two end caps and a heater cover panel 190 are fully assembled, i.e. an end cap over each end of a baseboard unit and a cover panel with each panel end inserted into an end cap shielding the underlying baseboard unit, the end caps can be fastened to a wall to fix the heater cover panel in place and restrict its removal. A fastener may be threaded through at least one bottom aperture 452 and into a wall such that the end caps are then secured to the wall. While the end caps holding the heater cover panel 190 are fixed to the wall, access to the underlying baseboard heater unit may be restricted. This deters unwanted tampering of the baseboard heater unit (e.g. removing metal for scrapping or rewiring of the unit).

The convertible end caps and cover plates described herein are particularly advantageous. The cutouts provide easy installation around piping or other components (obstacles) of the baseboard heater unit. In cases where there are no piping or obstacles, a cover plate may be secured to the interior surface of the end cap for aesthetic purposes.

The presently disclosed end caps with cover plates can be easily adapted to meet the needs of any project. As such, there is no inherent limit on their size, shape, or length, or the material from which they can be composed or the items they can be used to cover. In preferred embodiments, any one or more of the end cap and cover plate are made from steel, specifically galvanized steel and preferably at least 22 gauge steel. Any one or more of the end cap and cover plate can be power coated or painted to a desired color and to resist rusting of the steel.

The present system can be quickly and easily installed by sliding associated heater cover panels through the open side faces, which cover panels may be secured using one or more retainers. Associated fasteners may then be passed through the one or more apertures of the rear face(s) to secure the cover to a wall.

The present disclosure has been described with reference to exemplary embodiments. Modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. An end cap for a heater cover assembly, comprising:

a closed side face comprising an interior surface, exterior surface, and a cutout;

an open side face opposite the closed side face that accommodates the insertion of an associated heater cover panel;

a top face;

a front face comprising an interior surface and an exterior surface;

a rear face; and a retaining clip fixed to the interior surface of the closed side face above the cutout, the clip adapted to retain an associated cover plate which is inserted into the clip in a fixed position against the interior surface of the closed side face and at least partially covering the cutout.

2. The end cap of claim 1, further including the cover plate wherein the cover plate has a length L and a height H, the cutout has a length x and a height y, and the length L is greater than the length x.

3. The end cap of claim 2, wherein the cover plate includes a flat portion and a plateau portion, the flat portion adapted to abut the interior surface of the closed side face, the plateau portion adapted to fill the cutout portion of the closed side face such that when the cover portion is in place the exterior surface of the closed side face appears as a flat surface with no holes or vents.

4. The end cap of claim 1, wherein the cover plate has a flat front surface and a flat back surface, the flat front surface and flat back surface substantially parallel to each other.

5. The end cap of claim 1, wherein the retaining clip is rotatably fixed by a fastener to the interior surface of the closed side face.

6. The end cap of claim 1, wherein the rear face further comprises at least one bottom aperture positioned along a bottom edge of the rear face, which is adapted to accommodate a fastener for attaching the end cap to a wall.

7. The end cap of claim 1, wherein the front face comprises an angled upper surface and a vertical lower surface.

8. The end cap of claim 1, further comprising a retainer fixed to the interior surface of the front face adapted to hold the associated heater panel in place.

9. The end cap of claim 1, further comprising a top aperture positioned along a top edge of the rear face.

10. The end cap of claim 1, wherein the rear face is formed from a first strip and a second strip, the first strip located along a top rear edge of the top face, and the second strip located along a rear side edge.

11. The end cap of claim 1, wherein a front side edge of the front face is nonlinear or formed from multiple straight edges angled relative to adjacent edges.

12. A heater cover assembly for covering a baseboard heater, comprising:

a first end cap and a second end cap, wherein each end cap comprises:

a closed side face comprising an interior surface, and an exterior surface;

an open side face opposite the closed side face that accommodates the insertion of an associated heater cover panel;

a top face;

a front face comprising an interior surface and an exterior surface; and a rear face; and a first heater cover panel having a first panel end and a second panel end, wherein the first panel end is inserted into the open side face of the first end cap; and, wherein the first end cap further comprises:

a cutout located on the closed side face, the cutout having a length x and a height y;

a cover plate, having a length L and a height H, wherein the length L is greater than the length x; and a retaining clip fixed to the interior surface of the closed side face above the cutout, the clip adapted to receive the cover plate and to retain the cover plate in a fixed position against the interior surface of the closed side face and at least partially covering the cutout in the closed side face.

13. The assembly of claim 12, wherein each end cap further comprises a retainer fixed to the interior surface of the front face adapted to hold the first heater cover panel in place.

14. The assembly of claim 12, wherein the first panel end is held in place by the fixed retainer on the interior surface of the front face of the first end cap.

15. The assembly of claim 14, wherein the second panel end is inserted into the open side face of the second end cap and held in place by the fixed retainer on the interior surface of the front face of the second end cap.

16. The assembly of claim 12, wherein each end cap further comprises a top aperture positioned along a top edge of the rear face.

17. The assembly of claim 12, wherein the rear face of each end cap is formed from a first strip and a second strip, the first strip located along a top rear edge of the top face, and the second strip located along a rear side edge.

18. The assembly of claim 12, wherein the cover plate at least partially covers the cutout.

19. The assembly of claim 12, wherein the cover plate has a flat front surface and a flat back surface, the flat front surface and flat back surface substantially parallel to each other.

20. An end cap for a heater cover assembly, comprising:

a closed side face comprising an interior surface, exterior surface, and a cutout;

an open side face opposite the closed side face that accommodates the insertion of an associated heater cover panel;

a top face;

a front face comprising an interior surface and an exterior surface;

a rear face;

a cover plate that includes a flat portion and a plateau portion, the flat portion adapted to abut the interior surface of the closed side face, the plateau portion adapted to fill the cutout portion of the closed side face such that when the cover portion is in place the exterior surface of the closed side face appears as a flat surface with no holes or vents; and a retaining clip fixed to the interior surface of the closed side face above the cutout, the clip adapted to receive the cover plate and to retain the cover plate in a fixed position against the interior surface of the closed side face and at least partially covering the cutout.

* * * * *